US008206095B2

(12) United States Patent
Parker et al.

(10) Patent No.: US 8,206,095 B2
(45) Date of Patent: Jun. 26, 2012

(54) COMPOUND VARIABLE ELLIPTICAL AIRFOIL FILLET

(75) Inventors: David Parker, Palm Beach Gardens, FL (US); James Page Strohl, Stuart, FL (US)

(73) Assignee: Alstom Technology Ltd (CH)

( * ) Notice: Subject to any disclaimer, the term of this patent is extended or adjusted under 35 U.S.C. 154(b) by 793 days.

(21) Appl. No.: 12/273,695

(22) Filed: Nov. 19, 2008

(65) Prior Publication Data

US 2010/0284815 A1 Nov. 11, 2010

(51) Int. Cl.
*F03D 11/00* (2006.01)

(52) U.S. Cl. ..... 415/191; 416/193 A

(58) Field of Classification Search ..... 415/191; 416/193 A

See application file for complete search history.

(56) References Cited

U.S. PATENT DOCUMENTS

| | | | | |
|---|---|---|---|---|
| 7,063,509 | B2 * | 6/2006 | Snook et al. | 416/189 |
| 7,371,046 | B2 * | 5/2008 | Lee et al. | 415/191 |
| 2004/0062636 | A1 * | 4/2004 | Mazzola et al. | 415/115 |
| 2005/0036890 | A1 * | 2/2005 | Tomberg et al. | 416/192 |
| 2005/0106025 | A1 * | 5/2005 | Snook et al. | 416/189 |
| 2006/0275112 | A1 * | 12/2006 | Lee et al. | 415/191 |

* cited by examiner

*Primary Examiner* — Stephen W Smoot
*Assistant Examiner* — Robert Bachner
(74) *Attorney, Agent, or Firm* — Shook, Hardy & Bacon L.L.P.

(57) ABSTRACT

A gas turbine engine blade or vane having a first platform, an airfoil, and a compound fillet extending about a region where the airfoil joins the first platform is disclosed. The compound fillet has a first conic surface and a second conic surface, with the first conic surface tangent to the airfoil and to an offset platform surface and the second conic surface tangent to the first conic surface and the first platform. The two conic surfaces are of different sizes, with different radii, and the conic surfaces can vary in size about the periphery of the joint between the airfoil and the first platform.

20 Claims, 6 Drawing Sheets

COMPOUND VARIABLE ELLIPTICAL AIRFOIL FILLET

TECHNICAL FIELD

The present invention generally relates to a gas turbine blade or vane having an airfoil and more specifically to an improved airfoil-to-platform configuration for reducing the operating stresses in the blade or vane.

BACKGROUND OF THE INVENTION

Gas turbine engines operate to produce mechanical work or thrust. Specifically, land-based gas turbine engines typically have a generator coupled thereto for the purposes of generating electricity. A gas turbine engine comprises an inlet that directs air to a compressor section, which has stages of rotating compressor blades. As the air passes through the compressor, the pressure of the air increases. The compressed air is then directed into one or more combustors where fuel is injected into the compressed air and the mixture is ignited. The hot combustion gases are then directed from the combustion section to a turbine section by a transition duct. The hot combustion gases cause the stages of the turbine to rotate, which in turn, causes the compressor to rotate.

The air and hot combustion gases are directed through a compressor and turbine section, respectively, by compressor blades/vanes and turbine blades/vanes. These blades and vanes are subject to steady-state and vibratory stresses due to the thermal and mechanical loads applied to the airfoil surface. The blades and vanes often have at least one region where the airfoil section transitions to a wall portion, often referred to as a platform, that maintains an inner or outer air path. The transition between an airfoil and a platform can be a region of sharp geometry change that can further increase areas of high stress already present due to the thermal and mechanical stresses present.

SUMMARY

In accordance with the present invention, there is provided a novel configuration for a blade or vane of gas turbine engine compressor or turbine. The component has a compound fillet located at the region where an airfoil body intersects one or more platform surfaces. The compound fillet has at least two conic surfaces that extend about the region where the airfoil body and platform(s) intersect. The compound fillet provides a smooth transition between surfaces so as to reduce stresses found in this region.

In an embodiment of the present invention, a component for a gas turbine engine having a first platform, an airfoil extending away from the first platform, and a compound fillet about a region where the airfoil joins the first platform is disclosed. The compound fillet has a first conic surface and a second conic surface. The first conic surface is tangent to the airfoil and a platform offset surface while the second conic surface is tangent to the first conic surface and an outer surface of the first platform.

In an alternate embodiment, a component for a gas turbine engine having a first platform, an airfoil body extending from the first platform, and a variable compound fillet about a region where the airfoil joins the first platform is disclosed. The variable compound fillet has a first conic surface and a second conic surface. The first conic surface is tangent to the airfoil and a platform offset surface while the second conic surface is tangent to the first conic surface and an outer surface of the first platform. The conic surfaces vary in size around the region.

In yet another embodiment, a method of forming a variable compound fillet between an airfoil and a platform surface is disclosed. A platform offset surface is established a distance from the platform surface and a first conical transition is established tangent to a surface of the airfoil and the platform offset surface. One or more stress levels in the first conical transition and areas adjacent to the conical transition are calculated and a determination is made as to whether or not these stress level are at or below an acceptable level. If they are not acceptable, one or more of the parameters used to define the first conical transition are modified so as to alter the shape of the first conical transition, which will in turn alter the one or more stress levels. Once the stress levels are determined to be within an acceptable range, the first conical transition is smoothed and a conic fillet tangent to the first conical transition and the platform surface is established. The radii of these conical features are different and may vary about the region where the airfoil joins the platform surface.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
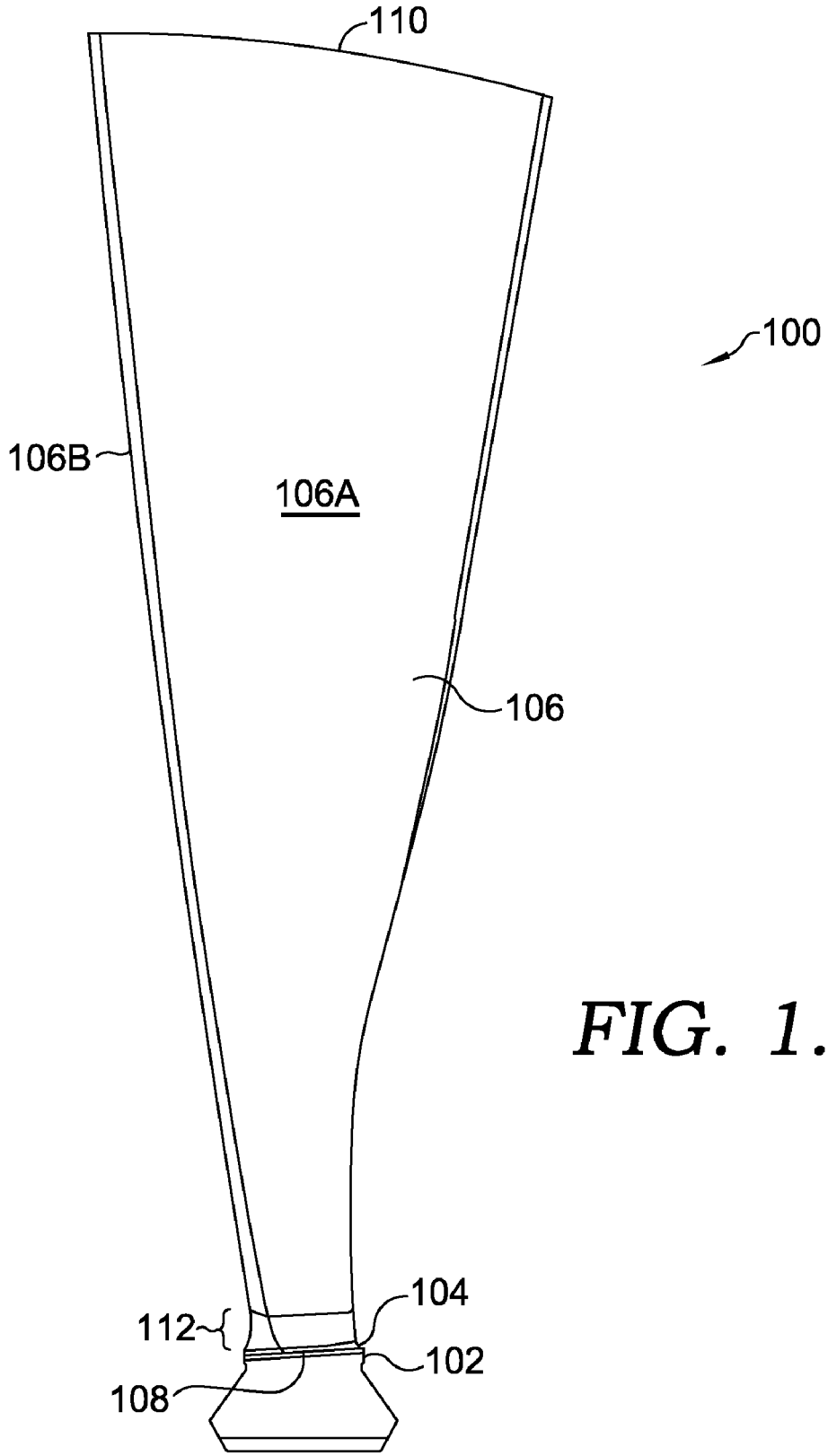
FIG. 1 is a front elevation view of a compressor blade in accordance with an embodiment of the present invention.
Figure 3:
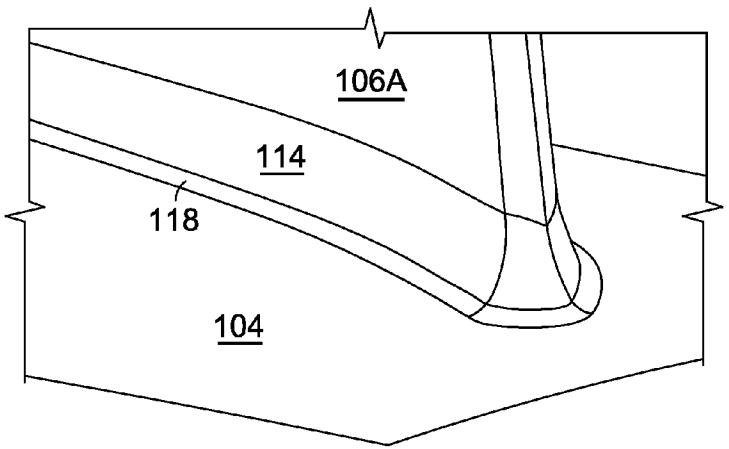
FIG. 3 is an alternate partial perspective view of the compressor blade of FIG. 1.
Figure 2:
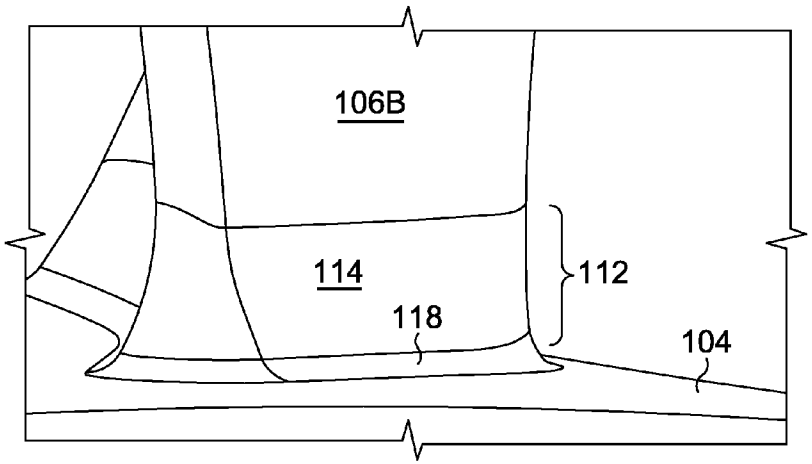
FIG. 2 is a partial perspective view of the compressor blade of FIG. 1.
Figure 4:
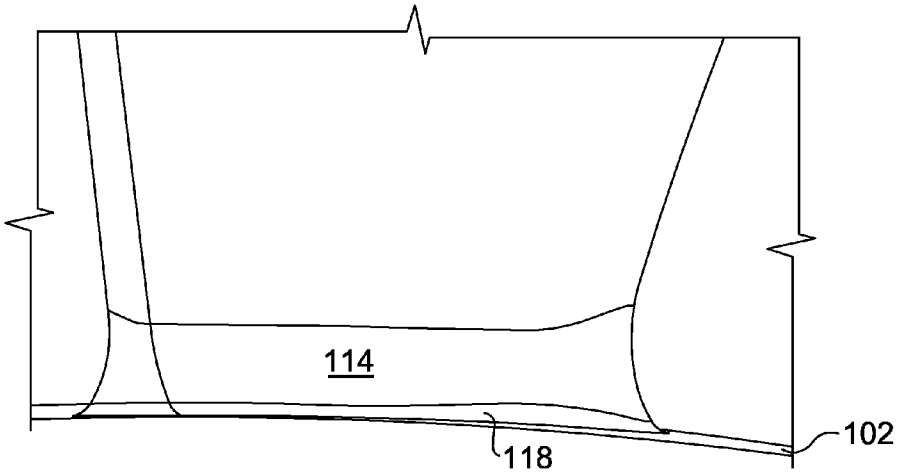
FIG. 4 is another partial perspective view of the compressor blade of FIG. 1.
Figure 5:
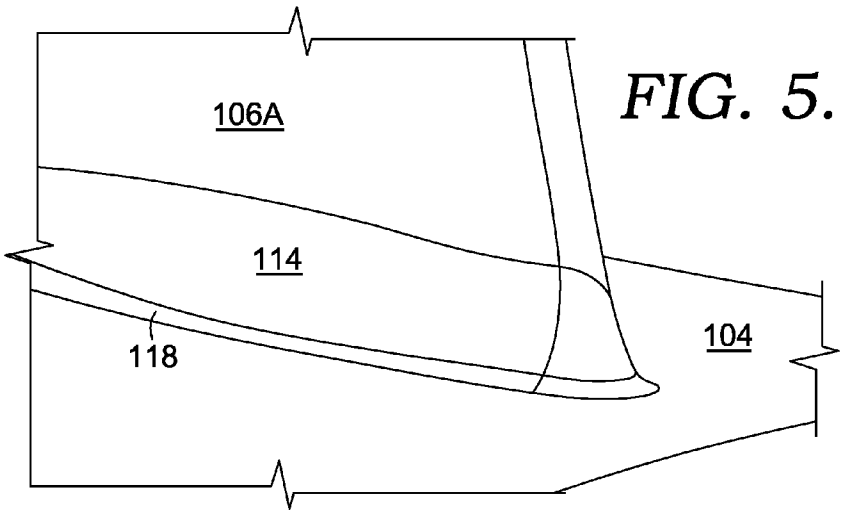
FIG. 5 is yet another partial perspective view of the compressor blade of FIG. 1.

Referring initially to FIG. 1, a gas turbine engine component 100, such as a compressor blade, is depicted. The component 100 has an attachment with a first platform 102 extending outward from the attachment where the first platform 102 has an outer surface 104. An airfoil 106 has a concave surface 106A and a convex surface 106B and extends away from the first platform 102 with the airfoil having a first end 108, and a second end 110, with the first end 108 located proximate the first platform 104.

As one skilled in the art understands, as a compressor blade or turbine blade is rotated by a corresponding disk, the weight of the blade pulls on the disk and a radially outward pulling load is created. However, because of blade design issues such as desired compression of the airflow or work output, blade materials, and compressor/turbine size, rarely is the only load a truly radial pulling load. The rotation of the disk also causes the blade to want to bend, imparting a bending stress at the joint between the airfoil and the platform. The greatest bending for an unshrouded blade, as depicted in FIG. 1, can be found at the second end 110 of the airfoil 106, which is the furthest point from its attachment. As such, this creates a large bending moment in the attachment region of the blade, and can create a large stress concentration at a location.

A compound fillet 112 extends about a region where the airfoil 106 joins the first platform 102, that is about a periphery of the first end 108. Further and more detailed views of the compound fillet 112 can be seen in FIGS. 2-6, with specific attention to FIG. 6. The compound fillet 112 has a first conic surface 114 tangent to the airfoil 106 and a platform offset surface 116. A platform offset surface 116 is essentially a construction feature used to layout the desired location of the first conic surface 114. The platform offset surface 116 is located beneath the outer surface 104 of the first platform 102. The term "beneath" can be subjective based on the orientation of the blade or vane and as the term is used herein, it is meant to describe an area within the thickness of the first platform 102. As one skilled in the art understands, a conic surface is defined by three parameters—a height offset, width offset, and eccentricity parameter—and not a single radius.

The compound fillet 112 also comprises a second conic surface 118 that is tangent to the first conic surface 114 and the outer surface 104 of the first platform 102. As such, the compound fillet 112 is formed by blending the first conic surface 114 and the second conic surface 118. It has been determined that an acceptable distance to sweep a curvature for the second conic surface 118 is approximately equivalent to a distance between the platform offset surface 116 and the outer surface 104 of the first platform 102.

Figure 6:
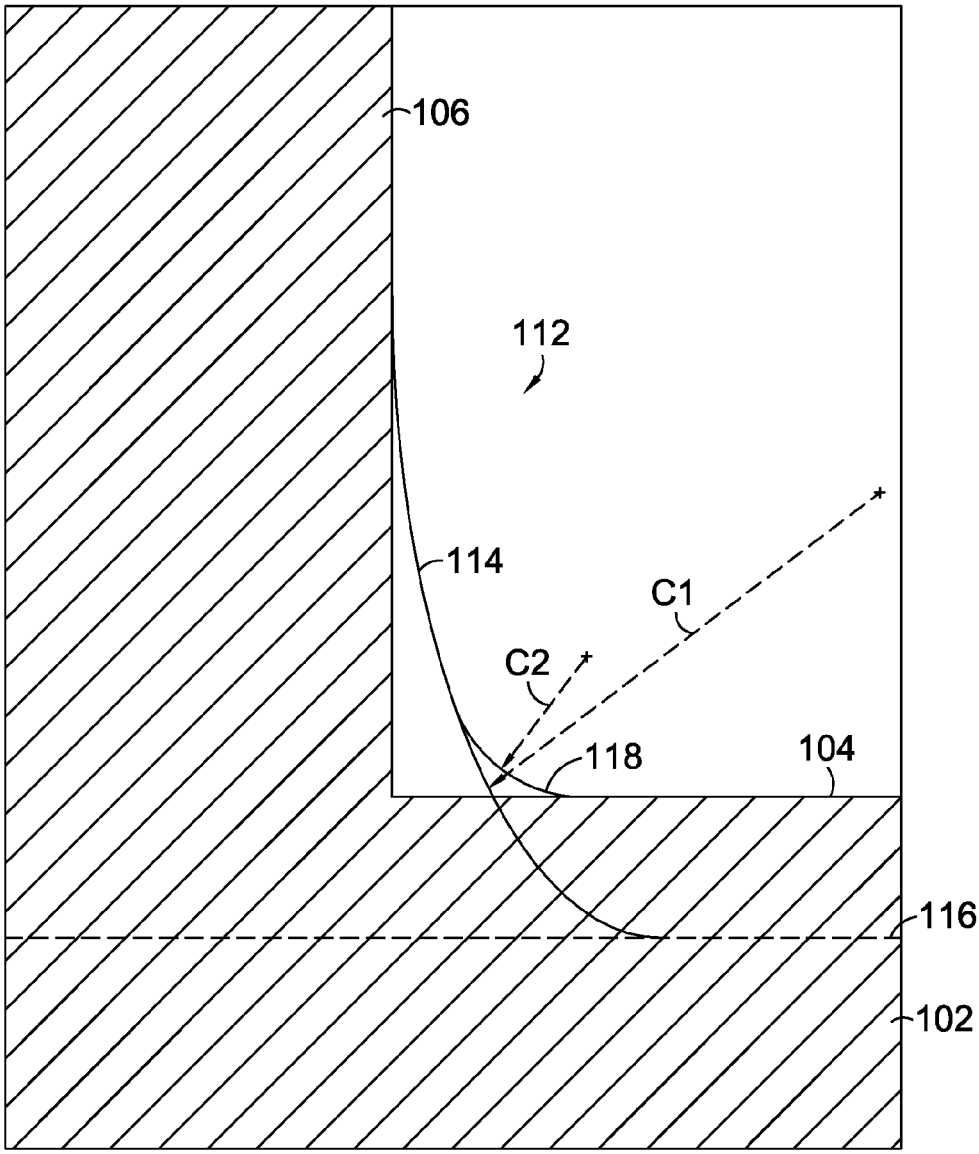
FIG. 6 is a partial cross section view of a compressor blade taken through the compound fillet between the airfoil and platform in accordance with an embodiment of the present invention.

As it can be seen from FIG. 6, the distances from which the curvatures for conic surfaces 114 and 118 are formed are of different sizes. Specifically, first conic surface 114 is formed from a conic C1 having a curvature generally larger than a second conic C2 that forms second conic surface 118. The exact size of the surfaces 114 and 118 will vary depending on a variety of factors associated with the blade or vane including blade size, location of airfoil relative to platform, orientation of the stress field in the airfoil-to-platform fillet, magnitude of stresses in the airfoil or platform, desired compression or pressure drop, air temperature, and blade material. Furthermore, the size of conics C1 and C2 may not necessarily be constant around the region where the compound fillet is located. The conics C1 and C2 can vary in size as necessary so as to direct stress to areas of the first platform 102, airfoil 106, or compound fillet 112 that can handle higher stress levels. Generally speaking, the larger the conics and therefore the larger the size of the conic surfaces 114 and 118, the lower the stress in that region, as the transition formed between the airfoil 106 and the first platform 102 is a more smooth transition and less susceptible to stress concentrations. As a result, the compound fillet 112 may be a variable compound fillet around the region where the airfoil 106 joins the first platform 102.

Figure 7:
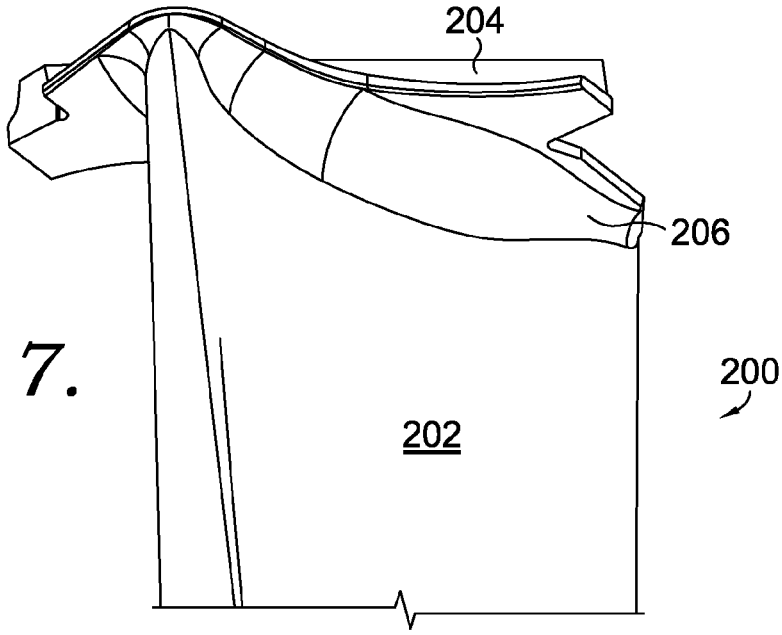
FIG. 7 is a partial perspective view of a shrouded blade in accordance with an alternate embodiment of the present invention.
Figure 8:
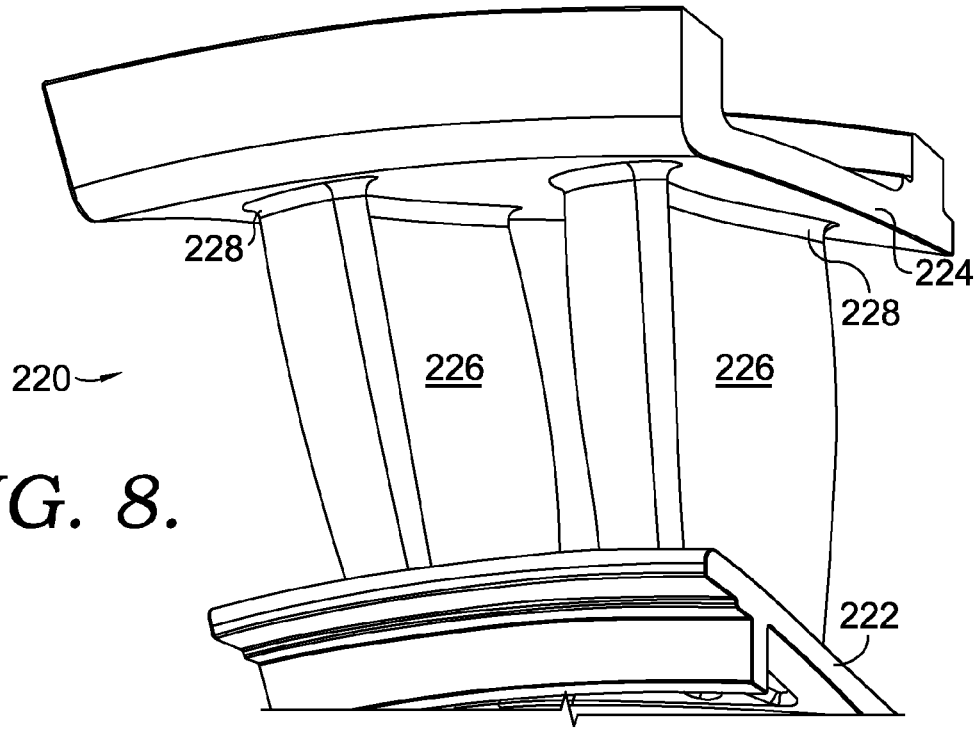
FIG. 8 is a perspective view of a turbine vane in accordance with yet another embodiment of the present invention; and, FIG. 9 is a flow chart depicting the process by which a compound fillet between an airfoil and a platform surface is created in accordance with an embodiment of the present invention.

As previously mentioned and depicted in FIG. 1, one such example of a gas turbine engine component 100 is a rotating compressor blade. However, alternate embodiments of the present invention that can incorporate a compound fillet include a turbine blade, or a stationary vane found in between rows of rotating compressor blades or rotating turbine blades. Depending on the size and location of the blade, a second platform may be present at the second end of the airfoil or at a location along the airfoil span. An example component having this configuration is depicted in FIGS. 7 and 8. FIG. 7 discloses a portion of a turbine blade 200 having an airfoil 202 and a shroud 204 at a tip of the airfoil 202. The typical fillet between the airfoil 202 and shroud 204 is replaced by a variable elliptical fillet 206. The variable elliptical fillet 206 achieves a similar purpose at this location as it does at the joint between the airfoil and the platform (see FIGS. 1-3) and the blade or vane thereby exhibits lower operating stresses. This second platform can be used for dampening vibrations found in longer airfoils or for providing an outer gas path seal. Turning to FIG. 8, a gas turbine vane 220 is shown and includes a radially inner platform 222 and a radially outer platform 224 are coupled together by one or more airfoils 226. The airfoils 226 are joined to the platforms by compound elliptical fillets 228.

Figure 9:
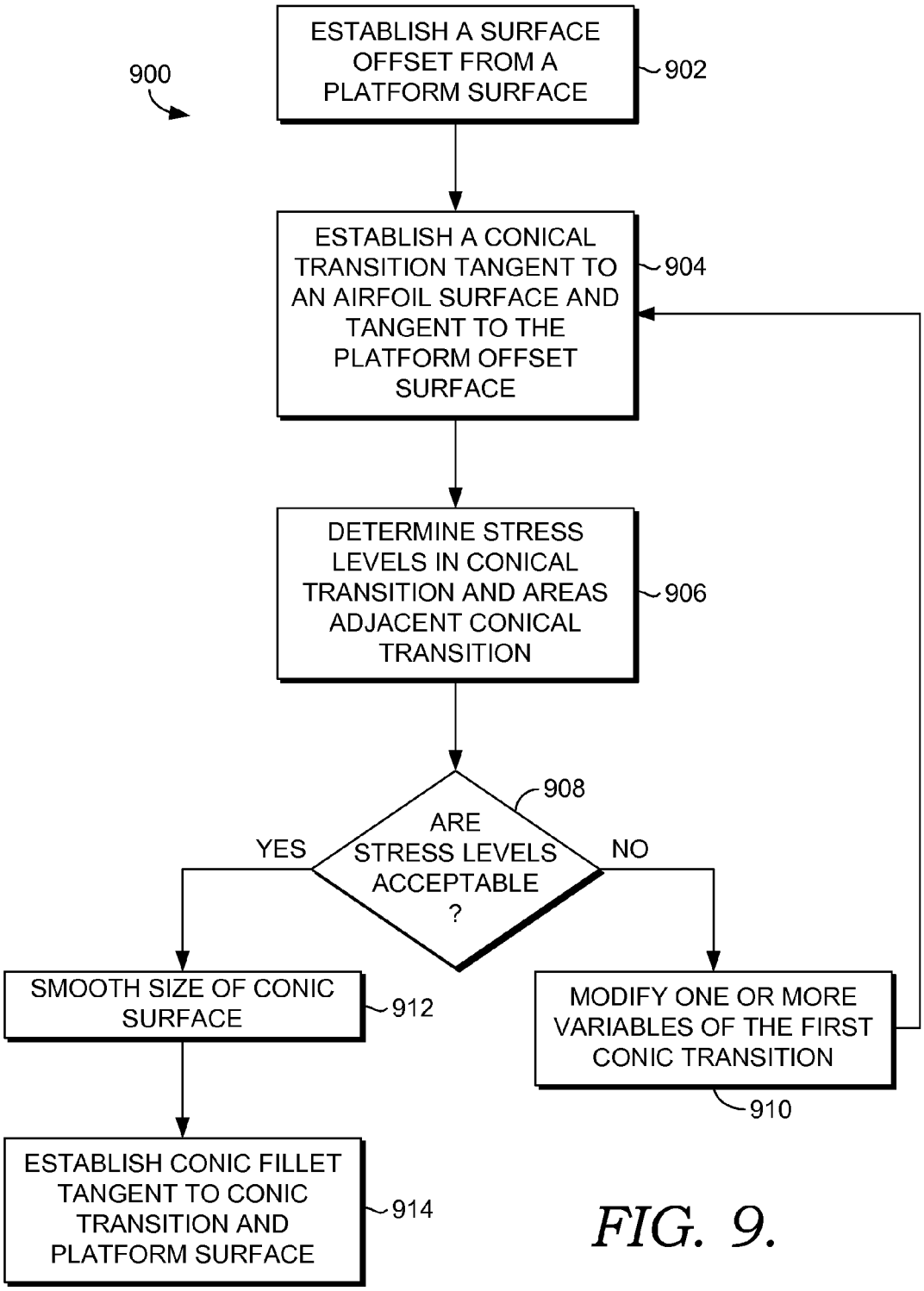

In an embodiment of the present invention a method of forming a variable compound fillet between an airfoil and a platform surface is disclosed. The variable compound fillet extends about a region where the airfoil joins the platform surface. The method 900 of forming the variable compound fillet is depicted in FIG. 9. The method 900 comprises a step 902 in which a platform offset surface is established a distance from the platform surface. As previously discussed, an offset surface 116 is shown in FIG. 6. In a step 904, a first conical transition being tangent to both a surface of the airfoil and the platform offset surface is established. Then, in a step 906, one or more stress levels in the first conical transition and areas of the airfoil and platform surface adjacent to the first conical transition are determined. Depending on the operating temperature and material of the blade or vane, desired operating stress levels (steady state, vibratory, etc) are known and the one or more stress levels for the blade or vane with the first conical transition are analyzed to determine if these stress level are at or below an acceptable level in a step 908.

If the one or more stress levels are determined to exceed acceptable levels, then in a step 910, one or more of the variables used to define the first conical transition, such as a height, width, and/or conic parameter are modified in an attempt to reduce the one or more stress levels to or below the acceptable level. Upon changing one or more of the variables, the process 900 returns to the step 904 where the first conical transition is established between the airfoil and the platform offset surface. This process of analyzing the one or more stresses in this region and adjusting the shape of the first conical transition continues until the stress level are at or below an acceptable level.

Once the one or more stress level are deemed acceptable in the step 908, the first conical transition is smoothed in a step 912 and in a step 914, a conic fillet (or second conic surface) is established tangent to the first conical transition and the platform surface.

This methodology can be applied to a variety of blade and vane configurations. For example, the method outlined above can be used to form a compound fillet between a second platform surface and the airfoil with the second platform located either at the second end of the airfoil or at a distance along the airfoil from the first platform.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A gas turbine engine component comprising:

a first platform having an outer surface;

an airfoil having a first end and a second end, the first end located proximate the first platform and the airfoil extending away from the first platform; and, a compound fillet extending about a region where the airfoil joins the first platform, the compound fillet having a first conic surface tangent to the airfoil and a platform offset surface, and a second conic surface tangent to the first conic surface and the outer surface of the first platform, wherein the platform offset surface is a plane extending through and generally parallel to the platform.

2. The component of claim 1 is a rotating blade or stationary vane of a compressor or turbine section of the gas turbine engine.

3. The component of claim 1, further comprising an attachment portion located adjacent to the platform and opposite of the airfoil.

4. The component of claim 1, further comprising a second platform located a distance from the first platform and a second compound fillet extending about a region where the airfoil joins the second platform.

5. The component of claim 1, wherein the platform offset surface is located beneath the outer surface of the platform.

6. The component of claim 1, wherein the first conic surface and second conic surface of the compound fillet vary in size around the region.

7. The component of claim 1, wherein the second conic surface is smaller than the first conic surface.

8. The component of claim 7, wherein a distance used to form a curvature of the second conic surface is approximately equivalent to a distance between the platform offset surface and the outer surface of the first platform.

9. An airfoil component for a gas turbine engine comprising:

a first platform having an outer surface;

an airfoil body extending from the first platform, the airfoil body having a first end, a second end, a concave surface, and a convex surface; and, a compound fillet having radii varying in size and located in a region where the airfoil joins the first platform, the compound fillet extending generally about a periphery of the first end of the airfoil body and comprising a first conic surface tangent to the airfoil and a platform offset surface, a second conic surface tangent to the first conic surface and the outer surface of the first platform, and wherein the first conic surface and the second conic surface are non-uniform about the region.

10. The airfoil component of claim 9 is a rotating blade or stationary vane of a compressor or turbine section of the gas turbine engine.

11. The airfoil component of claim 10, wherein the first platform is located adjacent to an attachment section of the airfoil component.

12. The airfoil component of claim 9, further comprising a second platform located at the second end of or along the airfoil, the second platform also having a first conic surface, the first conic surface being tangent to the airfoil and a platform offset surface, and a second conic surface, the second conic surface being tangent to the first conic surface and the outer surface of the first platform.

13. The airfoil component of claim 9, wherein the platform offset surface is located beneath the outer surface of the platform.

14. The airfoil component of claim 9, wherein the second conic surface is smaller than the first conic surface.

15. The airfoil component of claim 14, wherein a distance forming a curvature of the second conic surface is approximately equivalent to a distance between the platform offset surface and the outer surface of the first platform.

16. A method of forming a variable compound fillet between an airfoil and a platform surface, the variable compound fillet extending about a region where the airfoil joins the platform surface, the method comprising:

establishing a platform offset surface within the platform and located a distance from the platform surface;

establishing a first conical transition tangent to a surface of the airfoil and the platform offset surface;

determining one or more stress levels in the first conical transition and areas of the airfoil and the platform surface adjacent to the first conical transition;

determining whether or not the one or more stress levels are at or below an acceptable level;

smoothing the first conical transition; and, establishing a conic fillet tangent to the first conical transition and the platform surface.

17. The method of claim 16, further comprising modifying one or more variables of the first conical transition so as to reduce the one or more stress levels to or below the acceptable level.

18. The method of claim 16, wherein the first conical transition has a first radius and the conic fillet has a second radius.

19. The method of claim 16, wherein the conic fillet can be constant or variable in size about the region.

20. The method of claim 16, further comprising establishing a variable compound fillet between the airfoil and a second platform surface.

* * * * *